US007500943B1

(12) United States Patent
Peacocke et al.

(10) Patent No.: US 7,500,943 B1
(45) Date of Patent: Mar. 10, 2009

(54) CENTRIFUGAL SEPARATOR OF HEAVIER PARTICULATE MATERIALS FROM LIGHT PARTICULATE MATERIALS IN A SLURRY USING A RING IN THE COLLECTION RECESS

(75) Inventors: Kevin Gordon Peacocke, Borrowdale (ZW); Pete Taylor Simpson, Chisipite (ZW); Edwin John William Zonneveld, Fort Langley (CA)

(73) Assignee: Knelson Patents Inc., Langley, British Columbia (CA)

( * ) Notice: Subject to any disclaimer, the term of this patent is extended or adjusted under 35 U.S.C. 154(b) by 0 days.

(21) Appl. No.: 12/056,750

(22) Filed: Mar. 27, 2008

(51) Int. Cl.
*B04B 11/04* (2006.01)

(52) U.S. Cl. ..... 494/29; 494/80

(58) Field of Classification Search ..... 494/1, 494/5, 11, 23, 27–30, 36, 37, 63, 80; 210/360.1, 210/380.1; 209/453, 485
See application file for complete search history.

(56) References Cited

U.S. PATENT DOCUMENTS 1,988,500 A * 1/1935 Lack
4,608,040 A 8/1986 Knelson
4,776,833 A 10/1988 Knelson
5,222,933 A 6/1993 Knelson
5,230,797 A 7/1993 Knelson
5,338,284 A 8/1994 Knelson
5,421,806 A 6/1995 Knelson et al.
5,586,965 A 12/1996 Knelson
5,601,523 A 2/1997 Kenson
5,601,524 A * 2/1997 Knelson ..... 494/29
5,895,345 A 4/1999 Knelson
6,149,572 A 11/2000 Knelson

FOREIGN PATENT DOCUMENTS

AU 22055 * 4/1935

* cited by examiner

*Primary Examiner*—Charles E Cooley
(74) *Attorney, Agent, or Firm*—Adrian D. Battison; Ade & Company Inc.

(57) ABSTRACT

A centrifuge bowl for separating heavier particles from lighter particles and water comprises a conical lead-in wall leading of the bowl to a single recess or a pair of annular recesses at axially spaced positions. Each recess is generally V-shaped with an upper side wall, a lower side wall and a base. The base contains a plurality of angularly spaced valve controlled discharge ducts each having a mouth projecting through the base into the interior of the bowl for discharging the heavier particles in a continuous operation. The lead-in surface is stepped to cause tumbling of the flowing feed materials. The recess or recesses contain a concentrator ring which projects into the recess toward the base to reduce the amount of concentrate in the recess.

22 Claims, 3 Drawing Sheets

CENTRIFUGAL SEPARATOR OF HEAVIER PARTICULATE MATERIALS FROM LIGHT PARTICULATE MATERIALS IN A SLURRY USING A RING IN THE COLLECTION RECESS

This invention relates to a centrifugal separator of heavier particulate materials from light particulate materials in a slurry.

BACKGROUND OF THE INVENTION

In U.S. Pat. Nos. 4,608,040, 4,776,833, 5,222,933, 5,421,806, 5,230,797 and 5,338,284 of Benjamin Knelson and now assigned to the present Assignee is disclosed a centrifugal separator of the type including a rotatable bowl having a peripheral wall of generally frusto-conical shape on which is provided a plurality of axially spaced, annular recesses. The particulate material containing fractions of different specific gravity to be separated is fed in slurry form through a feed duct to a position at or adjacent a base of the bowl so that the feed materials flow outwardly onto and pass over the peripheral wall with heavier particulate materials collecting in the annular recesses while lighter particulate materials escape from the bowl through the open mouth. In the above patents, all of the annular recesses are fluidized by the injection of fluidizing water through holes in the peripheral wall at the respective recesses thus acting to fluidize the collecting material within the recesses.

A further arrangement is disclosed in U.S. Pat. No. 5,586,965, issued Dec. 24, 1996 of the above inventor in which the number of recesses is reduced and a frusto-conical lead-in section of the bowl is provided which is free from fluidized recesses so that the feed material is deposited onto the lead-in section and flows over that lead-in section prior to reaching the first annular recess. In this arrangement there are provided discharge ports at the base of the recess or recesses which are opened by valves periodically so that the concentrate is discharged from the recess on an effectively continuous basis as opposed to the batch collection basis of the above patents.

In U.S. Pat. No. 5,601,523 issued Feb. 11, 1997 of the above inventor there is disclosed a continuous machine of the above type where at each discharge port is provided a guide body which is generally a spherical ball located in the recess in front of the port. The balls are supported by a ring which extends around the recess at the mouth of the recess.

Further developments of this continuous machine are shown in U.S. Pat. No. 6,149,572 issued Nov. 21, 2000 where at each discharge port each spherical ball is located in the recess in front of the port by a support bar which extends across the recess.

It is also known, as shown in a brochure of a machine manufactured under the above patents to provide a diffuser ring which extends around the recess at the mouth leaving gaps between the top and bottom of the ring and the edge of the recess through which the heavier materials pass for collecting in the recess and for discharge through the ports as the valves are opened.

A further arrangement is disclosed in U.S. Pat. No. 5,895,345, issued Apr. 20, 1999 of the above inventor in which the amount of fluidizing water is reduced by supplying water only to some of the recesses of the bowl which are reduced in depth. This includes a lowermost section of the wall which has no fluidized recesses in a row of the shallower non-fluidized recesses.

SUMMARY OF THE INVENTION

It is one object of the invention to provide a centrifugal separator of heavier particulate materials from light particulate materials in a slurry and an insert member which can be used in an apparatus of this type as a retrofit.

According to one aspect of the invention there is provided an apparatus for separating intermixed particulate materials of different specific gravity in a slurry, comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

and an annular ring extending continuously around the annular recess;

the annular ring having an annular inner portion mounted at the mouth of the annular recess leaving a space above and below the ring for passage of materials into the recess from the bowl;

the annular ring having an annular outer portion extending from the inner portion generally radially outwardly into the recess to a position between the converging portions of the walls of the recess;

wherein the outer portion has an outermost face facing outwardly to the base and the discharge ports therein with the outer portion being shaped and arranged relative to the recess that the space between the outermost face and the discharge ports is open to cause the outermost face to act as a control surface of the materials in the recess at the discharge port.

Preferably the outer portion of the ring has top and bottom walls which converge toward the base of the recess.

The top and bottom walls may converge in steps or may be rounded and preferably are arranged such that a spacing from the top and bottom walls from the converging portions increases in an outward direction.

Preferably the top and bottom walls are symmetrical but this is not necessary as the operation is not symmetrical so that the spacing from the wall of the recess at the top may be wider than the spacing at the bottom.

Preferably the annular upper wall and the annular lower wall each include an inner portion inwardly of the converging portions which are substantially radial in direction and wherein the inner portion of the ring has top and bottom walls which are also substantially radial.

Preferably the inner portion of the ring has an inwardly facing surface which is substantially flat.

Preferably the inner portion of the ring has an inwardly facing surface which is substantially coplanar with the mouth at peripheral wall.

According to a second aspect of the invention there is provided an apparatus for separating intermixed particulate materials of different specific gravity in a slurry, comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

and an annular ring extending continuously around the annular recess;

the annular ring having an annular inner portion mounted at the mouth of the annular recess leaving a space above and below the ring for passage of materials into the recess from the bowl;

the annular ring having an annular outer portion extending from the inner portion generally radially outwardly into the recess to a position between the converging portions of the walls of the recess;

wherein the outer portion has top and bottom walls which converge toward the base of the recess.

According to a third aspect of the invention there is provided an insert member for use in an apparatus for separating intermixed particulate materials of different specific gravity in a slurry, the apparatus comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

the insert member comprising an annular ring;

the annular ring being shaped and arranged so as to extend continuously around the annular recess;

the annular ring having an annular inner portion shaped and arranged so as to be mounted at the mouth of the annular recess leaving a space above and below the ring for passage of materials into the recess from the bowl;

the annular ring having an annular outer portion shaped and arranged so as to extend from the inner portion generally radially outwardly into the recess to a position between the converging portions of the walls of the recess;

wherein the outer portion has an outermost face facing outwardly to the base which is free from elements attached to the ring member.

According to a fourth aspect of the invention there is provided an insert member for use in an apparatus for separating intermixed particulate materials of different specific gravity in a slurry, the apparatus comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

the insert member comprising an annular ring;

the annular ring being shaped and arranged so as to extend continuously around the annular recess;

the annular ring having an annular inner portion shaped and arranged so as to be mounted at the mouth of the annular recess leaving a space above and below the ring for passage of materials into the recess from the bowl;

the annular ring having an annular outer portion shaped and arranged so as to extend from the inner portion generally radially outwardly into the recess to a position between the converging portions of the walls of the recess;

wherein the outer portion has top and bottom walls shaped and arranged so as to converge.

In principle therefore concentrated slurry migrating up the wall of the concentrator and over the lead-in surface enters the concentrating recess through the lower opening at the base of the concentrate grade ring. The shape of the back of the concentrate grade enhancer serves to take up voidage volume and thus reduce the available space for particles to accumulate. As a result, lighter gangue or waste particles are replaced by the denser target particles. In this way the grade of the concentrate is increased because there are less gangue particles present.

The concentrate capture ring in concentrators has hitherto been deemed to be the final holding point before the concentrates are withdrawn from the concentrator. The concentrate present there was therefore the final product. By introducing the concentrate grade enhancer ring a further step of upgrading is introduced by forced exclusion of the light gangue particles.

The arrangements described herein can be used in batch machines where the bowl is stopped periodically to discharge collected materials from the collection recesses or in a continuous machine using a plurality of valve controlled discharge ports in the annular recess at angularly spaced positions for generally radially outward discharge of collected heavier materials from the annular recess for substantially continuous operation.

The number of collection recesses can vary in machines of this type depending on requirements bearing in mind that the number of recesses is generally smaller in continuous machines and larger in batch machines. The minimum number of recesses is therefore a single recess and the number can be considerably greater as required. Where definitions used herein refer to a "recess", it will be appreciated that this may be the only recess or may be one of a number of such recesses.

The description and definition of the arrangements herein use for convenience the terms "inward" and "outward" and these terms are used in relation to the axis of the bowl so that the former defines a direction toward the axis and the latter a direction away from the axis.

The description and definition of the arrangements herein use for convenience the terms "upper" and "lower", "top" and "bottom" and these terms are used in relation to a normal orientation of the bowl. However it will be appreciated that the bowl can be placed or may in fact be used in orientations different from the normal upright orientation.

The description and definition of the arrangements herein use for convenience the term "annular" which is used to indicate that the element concerned is an element which continuously surrounds the axis and is not intended to imply or specify any particular shape of the element in cross section or in plan.

The description and definition of the arrangements herein use for convenience the term "radial" which is used to indicate a direction generally toward or away from the axis and is not intended to indicate that the direction lies directly along a radius of the axis.

Devices of this type are typically be used where the heavier particles are to be collected and the lighter particles are gangue or waste. However in some cases this relationship is reversed.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
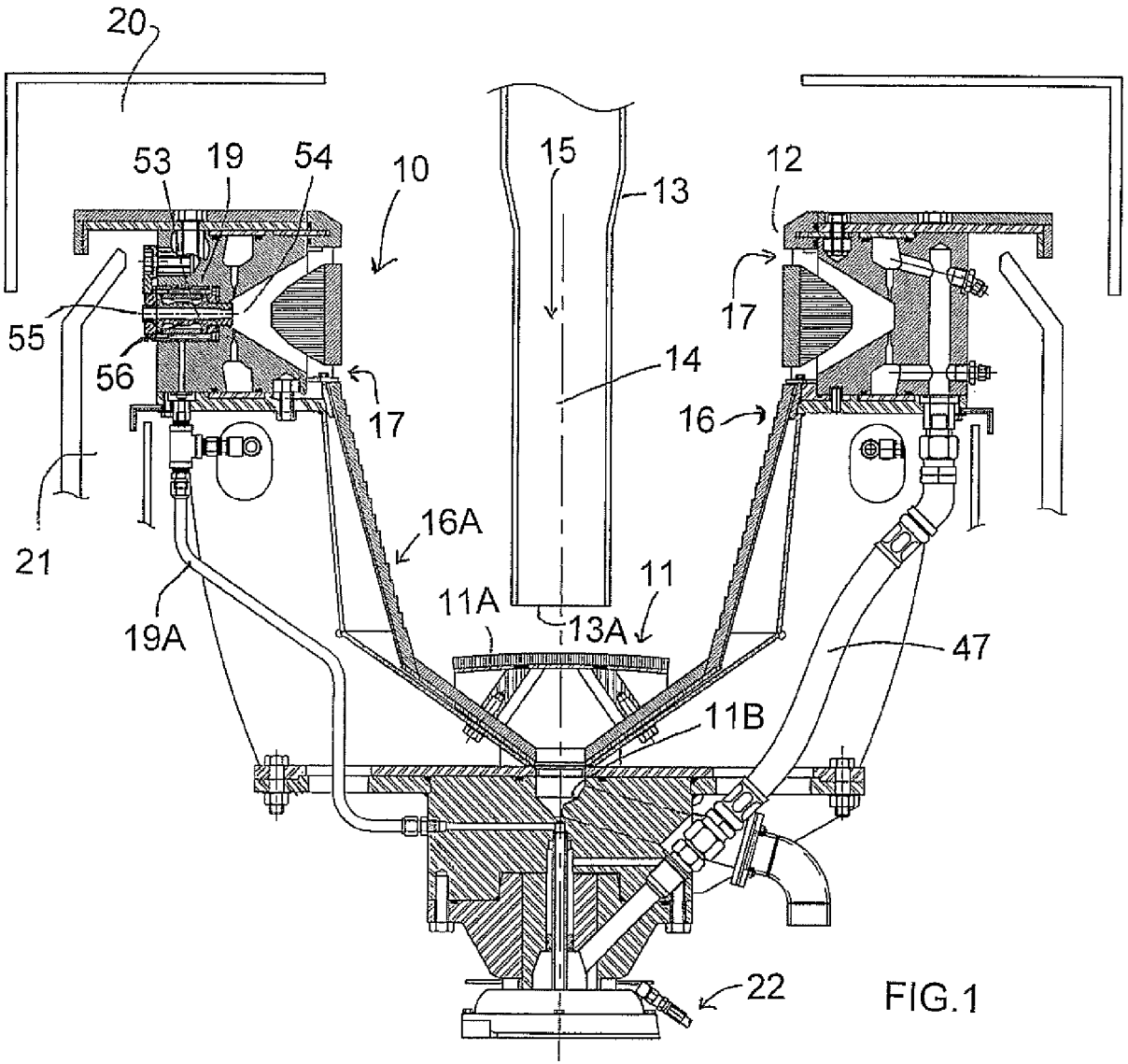
FIG. 1 is a vertical cross sectional view through an apparatus according to the present invention.
Figure 2:
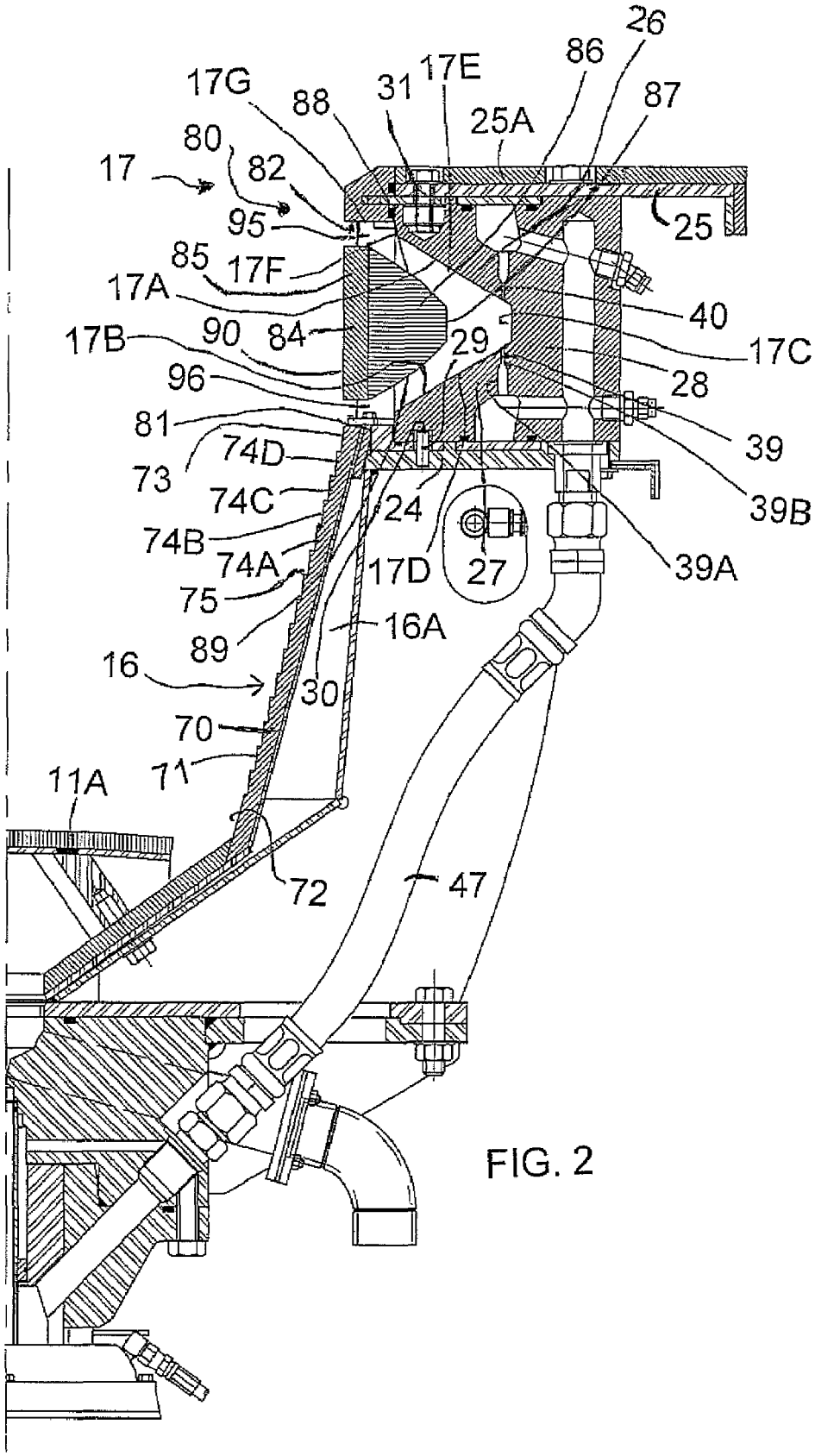
FIG. 2 is a vertical cross sectional view through one half of the bowl only of the apparatus of FIG. 1.
Figure 3:
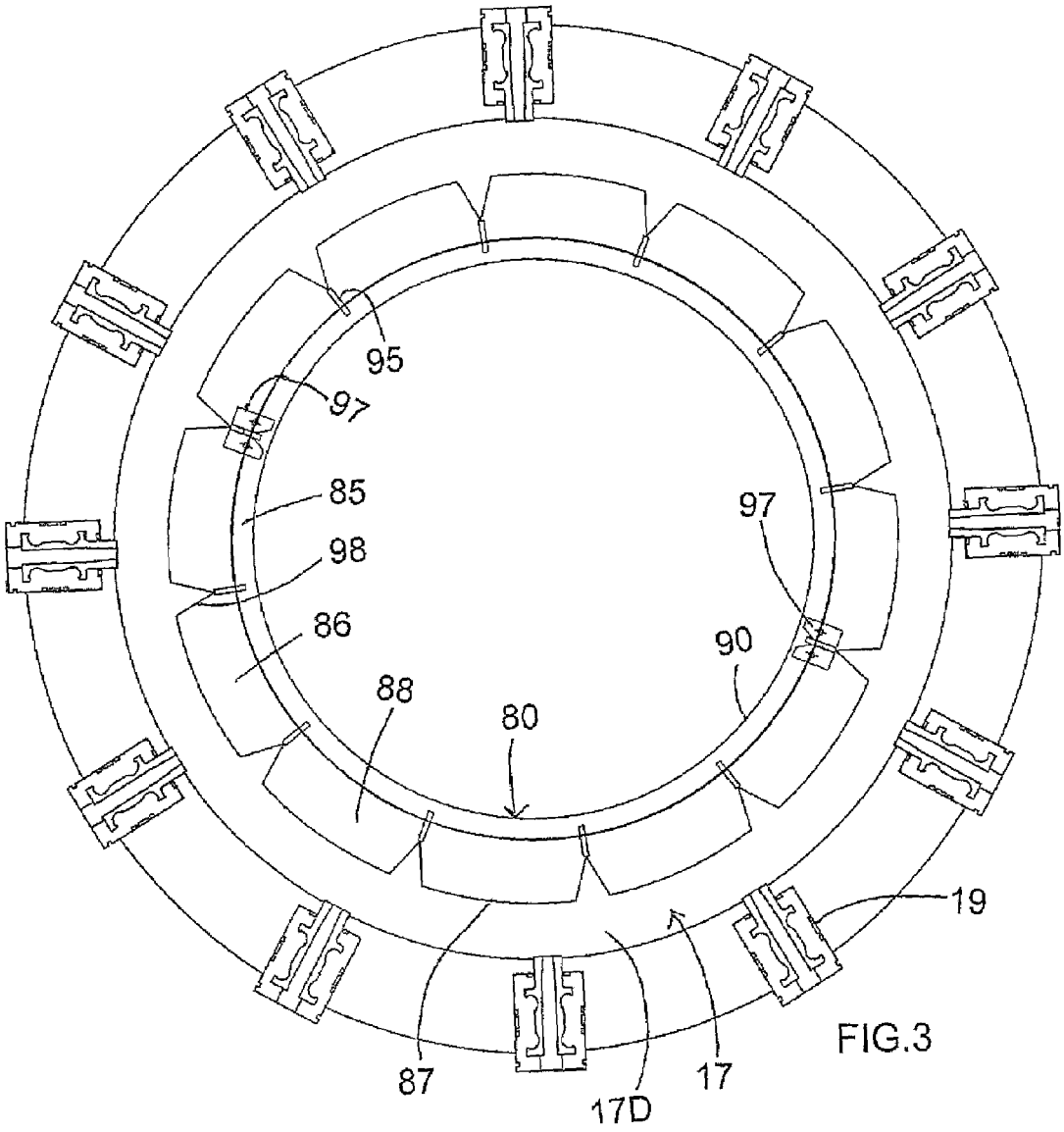
FIG. 3 is a horizontal cross sectional view through the bowl only of the apparatus of FIG. 1.

The centrifugal separation apparatus as shown in FIGS. 1 to 3 comprises a bowl generally indicated at 10 having a base 11 and an open mouth 12. A feed duct 13 comprises a vertical pipe mounted on a central axis 14 of the bowl for feeding a slurry 15 downwardly onto the base 11 of the bowl. The bowl 10 includes a peripheral wall 16 so that the slurry moving outwardly to the peripheral wall under centrifugal forces passes over the peripheral wall for collection of heavier materials into a collection recess 17 and for discharge of lighter materials and water over the open mouth 12. While one recess is shown, the number of recesses can be increased if required.

The material collecting in the recess 17 is discharged radially outwardly through a series of discharge ports at spaced positions around the recess. Each discharge port forms part of a discharge port and valve assembly 19.

The materials discharged from the open mouth are collected within a first launder 20 for collection and transportation to a discharge area. The heavier materials collected within the recess 17 is discharged from the assembly 19 and collected within a middle launder 21.

The bowl 10 is mounted on a shaft 22 for rotation about the axis 14. U.S. Pat. No. 5,222,933 discloses further details of the base of the bowl including a base plate 11A and a bottom discharge opening 11B. U.S. Pat. No. 5,601,523 discloses various constructional features of the above machine. Construction of the shaft is shown in U.S. Pat. No. 5,601,524. Further the general shape of the bowl including a lower frusto-conical portion 16 which directs the feed material across the recesses 17 and 18 is shown in U.S. Pat. No.

5,586,965. The further patents can be referred to for further details of the construction if required.

The construction of the bowl in the area of the recess 17 is shown in more detail in FIGS. 2 and 3. Thus the collection area of the bowl comprises a metal bottom plate 24 and a metal top plate 25. The metal bottom plate 24 is attached to the first conical inclined section 16A of the wall of the bowl. In between the metal plates 24 and 25 is provided the recess 17, which is molded or formed from a polyurethane material so as to be substantially rigid to provide some resilience and wear resistance. It is well known that centrifuge bowls accommodate significant levels of wear and for this purpose the use of polyurethane as a manufacturing material is well established.

This conical wall 16A forms a smooth run up zone or lead-in surface so that the feed material move outwardly from the base 11A onto the surface 16A and moves in a smooth flow to the recess 17 which is outward of the upper end of this surface. This surface is selected to be smooth in the belief that a smooth surface avoids disruption and thus aids both recover and grade of the target dense particles.

The recess 17 is generally annular defining a cylindrical outer surface 28 and extends outwardly from the upper end of the surface 16A. The recess 17 has a horizontal top wall 26 and horizontal bottom wall 27. The latter is attached to the top surface of the plate 24 and is located in position on the plate by guides pins 29 at spaced positions around the annular plate 24, the guide pins being received within a recess 30 formed in the wall 27. Similarly the top ring 25 has a bottom surface sitting in contact with the top surface of the wall 27 and a top surface carrying an outlet guide plate 25A extending from the mouth 12 to the launder 20. The whole structure including the recess 17, the top plate 25 and the bottom plate 24 is clamped together by a series of bolts 31 at angularly spaced positions around the structure. Each bolt 31 has a head received within a recess in the top plate 25A.

The recess 17 has a recess upper side surface 17A of the wall 26 and a lower side surface 17B of the wall 27 which converge outwardly to a flat base 17C with the base being annular and lying in a cylindrical surface surrounding the axis of the bowl. The shape and arrangement of the recesses is similar to that disclosed in U.S. Pat. No. 5,601,523. Each recess has a plurality of fluid injection openings 39 and 40 for injecting fluidizing water into the recess adjacent the base of the recess so the fluidizing water can flow through the recess and mix with the materials in the recess as described in the prior patents of Knelson. In this arrangement, as is best shown in FIG. 2, the injection openings are arranged to a first series of injection openings 40 located in the upper wall 17A adjacent to but spaced inwardly from the base 17C. A second series 39 of injection openings is arranged in the lower wall 17B again at a position adjacent to but spaced from the base 17C. Both sets of injection openings lie in a common cylindrical surface surrounding the axis of the bowl with the cylindrical surface spaced inwardly from the cylindrical surface containing the base 17C. Thus the injection openings are arranged to inject to the fluidizing water in a direction lying in a surface parallel to the axis.

As shown in FIG. 3, there is a series of such injection openings 39 and 40 at angularly spaced positions around the bowl. The injection openings lie in the cylindrical plane 41 but are inclined to a line 42 lying centrally of the base 17C so as to inject the water in a direction tending to flow in a direction 43 which is opposite to direction 44 of rotation of the bowl. Each injection opening is shaped with a first wider portion 39A and a second narrower portion 39B with the second portion having a mouth breaking out on the respective side wall. The length of the narrower portion is as short as reasonably practical so as to maintain the duct forming the injection opening at the wider dimension 39A for communication of fluid therethrough with reduced possibility for blockages. However it is required that the mouth of the injection opening at the side wall be relatively small so as to provide a jet of the fluidizing water entering the recess at the side wall with that jet having sufficient fluid flow to cause a significant jet of the fluidizing liquid across the base toward the opposite side wall.

The construction of the fluidizing water supply system from the hub to the ducts 39, 40 and the assembly 19 is shown in more detail in U.S. Pat. No. 6,149,572.

The assembly 19 comprises a duct 53 which is formed integrally from a resilient material and extends from a mouth 54 to an outer discharge end 55. The duct 53 includes a valve portion 56 and a tapered duct portion 57 extending from the mouth 54 to the valve portion 56. The duct defines an inner surface through which the heavier materials are discharged from the recesses to the launder 21. The tubular duct portion 57 has an outer surface which is generally cylindrical and projects forwardly from the assembly 19. The mouth 54 is arranged as an annular surface lying in a plane at right angles to a central axis of the duct and surrounding the tapered tubular portion 57 and inside the outer surface. For each discharge assembly, the recess has an opening into which the mouth can project from a chamber located between the recessed and the outer surface of the recess 17. Thus a forward portion of the mouth 54 projects slightly proud of the base 17C of the recess. The mouth 54 is thus substantially aligned with the jet from the inlet openings 39 and 40. In this way the jet from the inlet openings passes across the mouth in a sweeping action. The pressurized fluid for activating the valve portion is supplied to the valve through a pipe 19A.

The constriction of the hub and the supply of fluidizing liquid through the hub from the shaft and the supply of compressing fluid through the hub from the shaft is described and illustrated in detail in U.S. Pat. No. 5,601,524 and therefore will not be described in detail herein.

It will be noted however that the fluidizing liquid is supplied through a single source through the shaft and then connects to a plurality of angularly spaced supply ducts to the pipes 47. The pressurizing fluid, which is generally air, for the valves is supplied through two supply ducts to the pipes 19A.

In normal operation of the bowl as shown herein, the feed material is separated so that the heavier particles collect within the recess 17 and the lighter particles and water escape over the mouth 12. The heavier particles are then discharged by periodic opening of the pinch valves to allow release of a plug of collected heavier particles. At least one fluidization hole is aligned in front of each pinch valve exit jet to blow material away from the entrance to the exit jet. The recess 17 is V-shaped to direct material to the pinch valve. It can also be flattened out in front of the fluidization holes so as to prevent material from compacting in an otherwise elliptically exposed hole. In the event that the larger particles accumulate to a situation where blockage cannot be prevented, it is necessary to halt operation of the device, that is to halt the feed 15, to halt rotation of the bowl and to effect discharge of the heavier particles collected within the recess. As these heavier particles are generally the larger particles which have been collecting, it may not be necessary to collect the materials as concentrate but this can be done if preferred.

The above arrangement is substantially as described and shown in previous patents of the present Assignees.

In the present application two further significant modifications are made which enhance the operation of the general device described above.

Firstly a device inserted to enhance the separation of dense particles from light waste or gangue particles which consists of a series of sequential steps running up the lower wall of the concentrator, called the Run Up Zone.

There is thus provided in the bowl an insert member 70 mounted on the wall 16A which defines a lead-in surface 71 which extends axially of the peripheral wall from a lower end 72 on the peripheral wall arranged for receiving said feed materials from the discharge mouth 13A of the duct 13 to an upper end 73 of the lead-in surface at the recess 17. The lead-in surface is arranged such that in the bowl it is generally increasing in diameter from the lower end 72 to the upper end 73 so that the upper end is of greater diameter than the lower end. This generates a flow upwardly and outwardly which accelerates and moves toward the recess 17.

The lead-in surface 71 is shaped to define a series of axially spaced surface portions 74A to 74D each surrounding the axis with the portions being arranged in a row with each surface portion of the row being directly after the previous surface portion in the row. Each surface portion 74A of the row is of smaller diameter than a subsequent portion 74B of the row. Each surface portion 74A of the row has a trailing edge 74C which connects directly to a leading edge of the subsequent surface portion 74B of the row by an outwardly extending step 75.

The lead-in surface thus includes a plurality of step portions 75 thereon at axially spaced positions thereon with the step portions 75 arranged to provide a repeated tumbling action in the feed materials as the feed materials move over the lead-in surface.

The surface portions 74A, 74B are inclined outwardly and upwardly relative to a cylindrical surface and the steps 75 are substantially radial. However these angles are not essential and may be less aggressive so that the steps 75 are inclined outwardly and upwardly to a radial plane at an angle greater than the surface portions 74A.

The surface portions 74A etc extend in a row substantially continually from the base to the at least one recess. However this is not essential and there may be steps portions only over a part of the length of the surface 71, in which case a remaining part of the length of the lead-in surface 71 is frustoconical.

In the principle of operation, slurry introduced into the concentrator is accelerated by contact with the spinning surface 71 of the concentrator. As it is accelerated, the denser and coarser particles become more concentrated against the wall and as a result the slurry becomes thicker and more viscous in proximity of the wall. This thickening is counterproductive to the desired separation of particles as their relative mobility is impaired as a result. By introducing the series of steps 75, the thick slurry tumbles over the edge of the steps on its migration up the cone wall. With each tumbling action an opportunity is afforded for particles to sort themselves with the target denser particles moving closer to the wall under the force of the centrifugal gravity field and so displacing lighter waste or gangue particles. In this way the recovery of the denser target particles is increased as more find their way towards the wall where they are captured. The purity of the concentrate is also increased because more of the lighter gangue particles, which contaminate the concentrate, are rejected by the denser target particles.

The insert member 70 can be formed into the centrifugal concentrator either at the time of manufacture by casting the liner in the required shape, or a separate insert piece can be formed as an insert and retrofitted into concentrators already existing.

The height of the steps and the length of the surface portions can be varies between wide limits to obtain different angle of the wall as it increases in diameter toward the recess 17. The intended effect is that the feed materials as they flow over the surface pass over the step between each surface portion in turn with both the step and the surface portion being arranged to have some effect on the materials.

An increased effect can be provided by adding fluidizing ports in the lead-in surface for supplying fluidizing liquid onto the surface as the feed material flow over the surface. The fluidizing ports can be located in the surface portions 74A or in the steps 75. Suitable ducts to the exterior of the bowl can be provided to supply the fluidizing water or the insert member itself may carry a supply duct. The angle of the dust through the insert member to the surface may be selected tso that the water passes through the surface at a required angle to mix with the feed materials as they pass over the surface and tumble over the steps.

It will be appreciated that the steps move continually outwardly without any return portions extending inwardly since such portions act to define additional shallow recesses on the surface which merely act to collect additional material and thus are filled and do not affect the flow of the material passing over the filled recess.

Any kind of geometry or steps can be used on this surface that is in the run-up zone that disrupts the flow and could potentially achieve the same benefits. One example is the use of golf ball dimples which can be attached onto the surface. In all these cases the additional elements form an array of steps extending in both angular and axial direction so that the material tumbles over these steps as previously explained. The steps do not need to be annular, that is fully surrounding the axis.

The annular recess 17 has a mouth 80 at the peripheral wall defined by a bottom edge 81 and a top edge 82 over which the materials pass after the materials emerge from the last surface portion of the lead-in surface 16 of the bowl. The recess 17 is defined by the upper surface 17A and the lower surface 17B each extending generally outwardly from the peripheral wall. The annular upper wall and the annular lower wall each include portions 17E and 17D thereof which converge together toward the base 17C of the annular recess spaced outwardly of the peripheral wall. Adjacent the mouth 80, the surfaces 17A and 17B each include a vertical portion 17F followed by a horizontal portion 17G immediately at the mouth. Thus the spacing across the mouth is defined by the portions 17G which is greater than the spacing between the inner ends of the converging portions 17D and 17E.

Into the recess is mounted an annular ring 84 extending continuously around the annular recess. The annular ring has an annular inner portion 85 mounted at the mouth 80 of the annular recess leaving a space above and below the ring at the portions 17G and inwardly of the vertical portions 17F for passage of materials into the recess from the bowl. The annular ring has an annular outer portion 86 extending from the inner portion 85 generally radially outwardly into the recess to a position between the converging portions 17E and 17D of the walls of the recess. The outer portion 86 has an outermost face 87 facing outwardly to the base 17C and the discharge ports therein. The ring is intended as a guide surface for the materials and is not a support for other guide surfaces so that the outermost face 87 defines relative to the recess and particularly the base of the recess a space between the outermost face and the discharge ports. This space is open so that the outermost face 87 acts as a control surface of the materials in the recess at the discharge port.

The outer portion 86 of the ring has top and bottom walls 88 and 89 which converge toward the base of the recess so that they tend to follow the convergence of the portions 17D and 17E of the recess. As shown the top and bottom walls 88 and 89 are stepped rather than smooth so that they converge in steps. However the top and bottom walls can also be smoothly rounded. The top and bottom walls 88, 89 are also arranged such that a spacing from the top and bottom walls from the converging portions 17D and 17E increases in an outward direction with the face 87 being spaced from the base by a distance even greater than the spacing of the walls from the converging portions. Thus there is a point of closet approach on the converging portions which then opens up again outward of the ring. The top and bottom walls are symmetrical. The inner portion 85 of the ring has top and bottom walls which are also substantially radial and thus parallel to the portions 17G of the recess at the mouth 80. The inner portion 85 of the ring has in inwardly facing front surface 90 which is substantially flat and is substantially coplanar with the mouth 80 at peripheral wall.

The ring 84 is mounted in the recess 17 by a series of upstanding brackets 95, 96 which extend between the top of the ring and the top wall of the recess and between the bottom of the ring and the bottom wall of the recess. These simply span the space and act to prevent axial and radial movement. The brackets are located at angularly spaced positions around the ring so as to maintain the ring at the required axial position within the recess to prevent flexing. The ring is molded from the wear resistant material commonly used in the bowl. V-shaped cuts 98 are provided extending from the outer surface 87 to the brackets and simply make the production of piece easier by adding relief for flexing. They may or may not face the pinch valves.

Two anti rotation locks 97 to prevent angular movement are also provided at respective ones of the brackets 95, 96 and are mounted in the annular recess 17 to prevent rotation of ring 84.

The toroidal concentrate collection ring 84 has been found to increase the grade of the resulting concentrate. The ring has a flat inner face edge across the mouth of the concentrator and a rounded back edge protruding into the inner part of the concentrate collecting recess. Concentrated slurry migrating up the wall of the concentrator and over the stepped run up zone enters the recess through the lower opening at the base of the concentrate grade enhancer. The shape of the outer face of the concentrate grade enhancer ring 84 serves to take up voidage volume and thus reduce the available space for particles to accumulate. As a result, lighter gangue or waste particles are excluded at the expense of the denser target particles. In this way the grade of the concentrate is increased because there are less waste particles present.

The concentrate capture recess in concentrators has hitherto been deemed to be the final holding point before the concentrates are withdrawn from the concentrator. The concentrate present there was therefore the final product. By introducing the concentrate grade enhancer ring a further step of upgrading is introduced by forced exclusion of the light waste particles.

The concentrate grade enhancer can be installed into the concentrate collection recess of the concentrator, either at the time of manufacture, or as a retrofit. The concentrator is then operated in the normal mode of operation without any further special consideration.

The ring 84 can have any kind of shape that takes out ring volume.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus for separating intermixed particulate materials of different specific gravity in a slurry, comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

and an annular ring extending continuously around the annular recess;

the annular ring having an annular inner portion mounted at the mouth of the annular recess leaving a space above and below the ring for passage of materials into the recess from the bowl;

the annular ring having an annular outer portion extending from the inner portion generally radially outwardly into the recess to a position between the converging portions of the walls of the recess;

wherein the outer portion has an outermost face facing outwardly to the base and the discharge ports therein with the outer portion being shaped and arranged relative to the recess that the space between the outermost face and the discharge ports is open to cause the outermost face to act as a control surface of the materials in the recess at the discharge port.

2. The apparatus according to claim 1 wherein the outer portion of the ring has top and bottom walls which converge toward the base of the recess.

3. The apparatus according to claim 2 wherein the top and bottom walls converge in steps.

4. The apparatus according to claim 2 wherein the top and bottom walls are rounded.

5. The apparatus according to claim 2 wherein the top and bottom walls are arranged such that a spacing from of the top and bottom walls from the converging portions increases in an outward direction.

6. The apparatus according to claim 2 wherein the top and bottom walls are symmetrical.

7. The apparatus according to claim 1 wherein the annular upper wall and the annular lower wall each include an inner portion inwardly of the converging portions which are substantially radial in direction and wherein the inner portion of the ring has top and bottom walls which are also substantially radial.

8. The apparatus according to claim 1 wherein the inner portion of the ring has an inwardly facing surface which is substantially flat.

9. The apparatus according to claim 1 wherein the inner portion of the ring has in inwardly facing surface which is substantially coplanar with the mouth at peripheral wall.

10. An apparatus for separating intermixed particulate materials of different specific gravity in a slurry, comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

and an annular ring extending continuously around the annular recess;

the annular ring having an annular inner portion mounted at the mouth of the annular recess leaving a space above and below the ring for passage of materials into the recess from the bowl;

the annular ring having an annular outer portion extending from the inner portion generally radially outwardly into the recess to a position between the converging portions of the walls of the recess;

wherein the outer portion has top and bottom walls which converge toward the base of the recess.

11. The apparatus according to claim 10 wherein the top and bottom walls converge in steps.

12. The apparatus according to claim 10 wherein the top and bottom walls are rounded.

13. The apparatus according to claim 10 wherein the top and bottom walls are arranged such that a spacing from of the top and bottom walls from the converging portions increases in an outward direction.

14. The apparatus according to claim 10 wherein the annular upper wall and the annular lower wall each include an inner portion inwardly of the converging portions which are substantially radial in direction and wherein the inner portion of the ring has top and bottom walls which are also substantially radial.

15. The apparatus according to claim 10 wherein the inner portion of the ring has in inwardly facing surface which is substantially flat.

16. The apparatus according to claim 10 wherein the inner portion of the ring has in inwardly facing surface which is substantially coplanar with the mouth at peripheral wall.

17. An insert member for use in an apparatus for separating intermixed particulate materials of different specific gravity in a slurry, the apparatus comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

the insert member comprising an annular ring;

the annular ring being shaped and arranged so as to extend continuously around the annular recess;

the annular ring having an annular inner portion shaped and arranged so as to be mounted at the mouth of the annular recess leaving a space above and below the ring for passage of materials into the recess from the bowl;

the annular ring having an annular outer portion shaped and arranged so as to extend from the inner portion generally radially outwardly into the recess to a position between the converging portions of the walls of the recess;

wherein the outer portion has an outermost face facing outwardly to the base which is free from elements attached to the ring member.

18. The insert member according to claim 17 wherein the outer portion of the ring has top and bottom walls which converge.

19. The insert member according to claim 17 wherein the top and bottom walls converge in steps.

20. The insert member according to claim 17 wherein the inner portion of the ring has top and bottom walls which are substantially radial.

21. The insert member according to claim 17 wherein the inner portion of the ring has an inwardly facing surface which is substantially flat.

22. An insert member for use in an apparatus for separating intermixed particulate materials of different specific gravity in a slurry, the apparatus comprising:

a centrifuge bowl having a base and a peripheral wall surrounding an axis passing through the base and generally upstanding from the base to an open mouth;

a mounting arrangement for rotating the bowl around the axis;

a feed duct having a discharge mouth adjacent the base of the bowl for feeding the slurry into the bowl during rotation of the bowl so that, during rotation of the bowl, the intermixed particulate materials flow over the peripheral wall of the bowl from the base for collection of heavier particulate materials on the peripheral wall and for discharge of the lighter particulate materials in the slurry from the open mouth;

a launder for collecting the lighter particulate materials in the slurry discharged from the open mouth;

an annular recess having a mouth at the peripheral wall over which the materials pass when fed from the supply duct as the materials pass to the open mouth of the bowl for collection of the heavier materials in the annular recess;

the annular recess comprising an annular upper wall and an annular lower wall each extending generally outwardly from the peripheral wall;

the annular upper wall and the annular lower wall including at least portions thereof which converge together toward a base of the annular recess spaced outwardly of the peripheral wall;

fluidizing openings in the annular recess at or adjacent the base at angularly spaced positions for fluidizing said heavier materials in the annular recess;

a plurality of valve controlled discharge ports in the annular recess at angularly spaced positions for generally radially outward discharge of collected heavier materials from the annular recess for substantially continuous operation;

the insert member comprising an annular ring;

the annular ring being shaped and arranged so as to extend continuously around the annular recess;

the annular ring having an annular inner portion shaped and arranged so as to be mounted at the mouth of the annular recess leaving a space above and below the ring for passage of materials into the recess from the bowl;

the annular ring having an annular outer portion shaped and arranged so as to extend from the inner portion generally radially outwardly into the recess to a position between the converging portions of the walls of the recess;

wherein the outer portion has top and bottom walls shaped and arranged so as to converge.

* * * * *